US009491979B2

(12) United States Patent
Kim

(10) Patent No.: US 9,491,979 B2
(45) Date of Patent: Nov. 15, 2016

(54) BALACLAVA WITH REMOVABLE FACE MASK

(71) Applicant: Balboa Manufacturing Company, LLC, San Diego, CA (US)

(72) Inventor: Kyoung Kim, San Diego, CA (US)

(73) Assignee: BALBOA MANUFACTURING COMPANY, LLC, San Diego, CA (US)

( * ) Notice: Subject to any disclaimer, the term of this patent is extended or adjusted under 35 U.S.C. 154(b) by 0 days.

(21) Appl. No.: 14/518,657

(22) Filed: Oct. 20, 2014

(65) Prior Publication Data

US 2015/0113711 A1 Apr. 30, 2015

Related U.S. Application Data

(60) Provisional application No. 61/897,357, filed on Oct. 30, 2013.

(51) Int. Cl.

| | |
|---|---|
| ***A42B 1/20*** | (2006.01) |
| ***A42B 7/00*** | (2006.01) |
| ***A42B 1/04*** | (2006.01) |

(52) U.S. Cl.

CPC ..... *A42B 1/205* (2013.01); *A42B 1/046* (2013.01); *A42B 7/00* (2013.01)

(58) Field of Classification Search

CPC ..... A42B 3/18; A42B 3/221; A42B 3/222; A42B 7/00; A42B 1/046; A42B 1/04

USPC ..... 2/424, 429, 918, 202, 206

See application file for complete search history.

(56) References Cited

U.S. PATENT DOCUMENTS

| | | | | | |
|---|---|---|---|---|---|
| 1,299,611 | A | * | 4/1919 | Przybysz | A42B 3/08 2/10 |
| 4,090,510 | A | | 5/1978 | Segersten | |
| 4,641,379 | A | | 2/1987 | Martin | |
| 4,713,844 | A | * | 12/1987 | Westgate | A42B 3/22 2/411 |
| 4,768,235 | A | | 9/1988 | Webster | |
| 4,825,474 | A | | 5/1989 | Edwards | |
| 4,847,921 | A | * | 7/1989 | Leutholt | A63B 71/10 2/206 |
| 4,941,467 | A | | 7/1990 | Takata | |
| 5,062,163 | A | * | 11/1991 | Avey | A42B 1/067 2/410 |
| 5,157,794 | A | * | 10/1992 | Kamata | A42B 3/281 2/424 |
| 5,214,804 | A | | 6/1993 | Carey et al. | |

(Continued)

FOREIGN PATENT DOCUMENTS

WO 2010/023565 A1 3/2010

OTHER PUBLICATIONS

Alford. "Battling the Arctic Air: ColdAvenger Expedition Balaclava." Snowshoe Magazine. Dec. 14, 2010.

(Continued)

*Primary Examiner* — Shaun R Hurley
*Assistant Examiner* — Bao-Thieu L Nguyen
(74) *Attorney, Agent, or Firm* — Procopio, Cory, Hargreaves & Savitch LLP

(57) ABSTRACT

A balaclava designed for covering a wearer's head and at least part of their neck has a face opening, and a removable, face conforming mask is releasably securable to the balaclava to cover part of the face opening corresponding to the part of a wearer's face below the eyes. The mask is designed to conform to the general contours of a wearer's lower face including the nose and mouth region, and has appropriate openings for breathing purposes.

16 Claims, 11 Drawing Sheets

(56) References Cited

U.S. PATENT DOCUMENTS 5,265,280 A 11/1993 Walsh
5,575,009 A * 11/1996 Ryvin ..... A41D 13/1153 2/173
5,666,671 A 9/1997 Daneshvar
5,671,483 A * 9/1997 Reuber ..... A42B 3/24 2/424
5,704,068 A * 1/1998 Martin ..... 2/173
5,711,033 A * 1/1998 Green ..... A42B 3/286 2/171.3
5,713,077 A 2/1998 Humbrecht
5,845,340 A * 12/1998 Frislie ..... 2/202
D440,302 S 4/2001 Wolfe
6,272,690 B1 * 8/2001 Carey et al. ..... 2/206
7,058,991 B2 6/2006 Hartman et al.
7,152,252 B2 * 12/2006 Gellis et al. ..... 2/206
7,188,374 B2 3/2007 Carey
7,272,861 B2 9/2007 Colletti et al.
7,308,721 B1 12/2007 Rivera, Jr.
7,467,422 B2 * 12/2008 Bugarin ..... 2/202
7,603,724 B2 * 10/2009 Mickle ..... 2/173
D604,910 S 11/2009 Smaller
7,926,487 B2 4/2011 Drew et al.
8,161,575 B2 4/2012 Debrick
8,176,574 B2 * 5/2012 Bryant ..... A42B 3/328 2/410
8,201,276 B2 6/2012 Asta
D665,536 S 8/2012 Jenke et al.
8,555,418 B2 * 10/2013 Singh et al. ..... 2/173
8,733,357 B2 * 5/2014 Sullivan, Jr. ..... 128/206.22
D712,097 S * 8/2014 Sullivan, Jr. ..... D29/108
2003/0154536 A1 8/2003 Anderson
2004/0237964 A1 12/2004 Bostock et al.
2005/0133034 A1 6/2005 Jensen
2006/0085881 A1 * 4/2006 Gellis ..... A41D 13/11 2/9
2007/0101996 A1 5/2007 Carstens
2007/0204384 A1 9/2007 Carey
2007/0266483 A1 11/2007 Probst
2008/0115671 A1 5/2008 Sauer et al.
2009/0014007 A1 1/2009 Brambilla et al.
2009/0064385 A1 3/2009 Crossman et al.
2009/0151049 A1 * 6/2009 Conrardy et al. ..... 2/206
2010/0024826 A1 2/2010 Sullivan, Jr.
2010/0107318 A1 5/2010 Asta
2010/0319110 A1 12/2010 Preston-Powers
2011/0145964 A1 * 6/2011 Crye ..... F41H 1/04 2/2.5
2012/0066813 A1 * 3/2012 Singh ..... A42B 3/18 2/173
2012/0216340 A1 8/2012 Asta
2012/0317706 A1 12/2012 Lebel et al.
2013/0055486 A1 3/2013 Hasbany et al.
2013/0152930 A1 6/2013 Votel et al.
2014/0202469 A1 7/2014 Smaller
2014/0283280 A1 * 9/2014 Sullivan, Jr. ..... 2/173

OTHER PUBLICATIONS

International Search Report and Written Opinion for related PCT application No. PCT/US2014/061364, mailed on Jan. 29, 2015, in 10 pages.

* cited by examiner

BALACLAVA WITH REMOVABLE FACE MASK

BACKGROUND

1. Technical Field

The present disclosure generally relates to balaclava type headgear, and is particularly concerned with such headgear including a removable face mask covering part of the wearer's face.

2. Related Art

Known balaclavas are typically of flexible materials such as cloth, wool, or the like and are designed to be pulled on over the head, and have a head or helmet portion which covers the wearer's head and part of the face, a downwardly depending, integral neck portion, and a front opening which may expose the eye region of the face or the entire face apart from the forehead. Some prior art balaclavas are formed with an integral partial face mask extending over the nose and mouth. Balaclavas are often worn for warmth and protection in various activities such as sports, motorcycle riding, skiing, snowmobiling and the like.

Face mask and face protection devices that provide coverage of the wearer's nose and mouth to protect these areas from the weather as well as hazards such as flying debris are also known. These devices have the drawback of needing to be completely removed if the user decides they want to uncover their lower face.

SUMMARY

A combined balaclava and protective face mask device is described herein. In one aspect, the combined device comprises a balaclava with a face opening and a removable face conforming mask releasably securable in the face opening to cover the part of a wearer's face below the eyes. The mask is of the same or a different material from the balaclava, and may be pre-formed with contours for fitting to the contours of the portion of the face over which it extends. The wearer can decide whether or not to utilize the mask based on the type of activity, weather conditions, and likelihood of encountering dust, debris, rain, sleet or snow. The user can use the mask portion and then easily remove it during rest from the activity. The face mask is configured to allow the user to breathe and communicate easily via holes or other specialized fabric.

In one aspect, the balaclava is of soft, flexible material and has a head or helmet portion which covers a wearer's head and has a face opening, and a neck portion extending downwardly from the head portion for covering the entire neck and sometimes extending below the neck. The face conforming mask in one aspect is of semi-soft malleable material such as neoprene which is preformed to match the general contours of a wearer's lower face. In some embodiments the face mask has a protruding nose-receiving portion and mouth portion, in other embodiments the nose and mouth area is formed with a permeable fabric or another type of openings so that the user can breathe and speak comfortably. Portions of the balaclava adjacent the face opening and the periphery of the mask have mateable fastener device(s) for releasably securing the mask over a lower portion of the face opening. Openings are provided in the mask over the mouth region and in the part of the nose-receiving portion designed to engage over the nostril openings. Seams may be provided in the mask in order to enable the mask to fit more closely to the face.

In one aspect, the mateable fastener devices may be strips of mating hook-and-loop fastener material, zipper(s) or may be other means of fastening such as snaps or buttons. The openings over the mouth region may be multiple small, filter-like openings to exclude debris from entering the mask but allowing the user to breathe and speak. Some embodiments include a dart notch located below the eyes on each side of the removable mask which provides for a more contoured fit. The openings in the nose-receiving portion may comprise one or more openings for engagement under the respective nostril openings, which face generally downward when the mask is worn with the balaclava.

The face mask also allows devices to be attached to it. Previous balaclavas do not offer a combination balaclava or other head covering which includes a fully removable, interchangeable face mask designed to allow a wearer the maximum number of options depending on their needs on that particular day. For example, if the mask is being worn in tactical situations, the wearer may switch out one face mask for another in which the camouflage more closely matches the surrounding environment. In other cases, the wearer may need to switch a basic face mask for one with more specific components to match the wearer's needs.

BRIEF DESCRIPTION OF THE DRAWINGS

Embodiments are illustrated by way of example in the accompanying drawings, in which like reference numbers refer to like parts, and in which.

DETAILED DESCRIPTION

Certain embodiments as disclosed herein provide for a combined balaclava and face mask, with the face mask removably securable to the face opening in the balaclava so that it can be used when needed, with the wearer having the option of wearing the balaclava alone with the face opening completely open or with the face mask attached to cover and protect the lower part of the face.

After reading this description, it will become apparent to one skilled in the art how to implement the invention in various alternative embodiments and alternative applications. However, although various embodiments are described herein, it will be understood that these embodiments are presented by way of example only, and not limitation.

Figure 1:
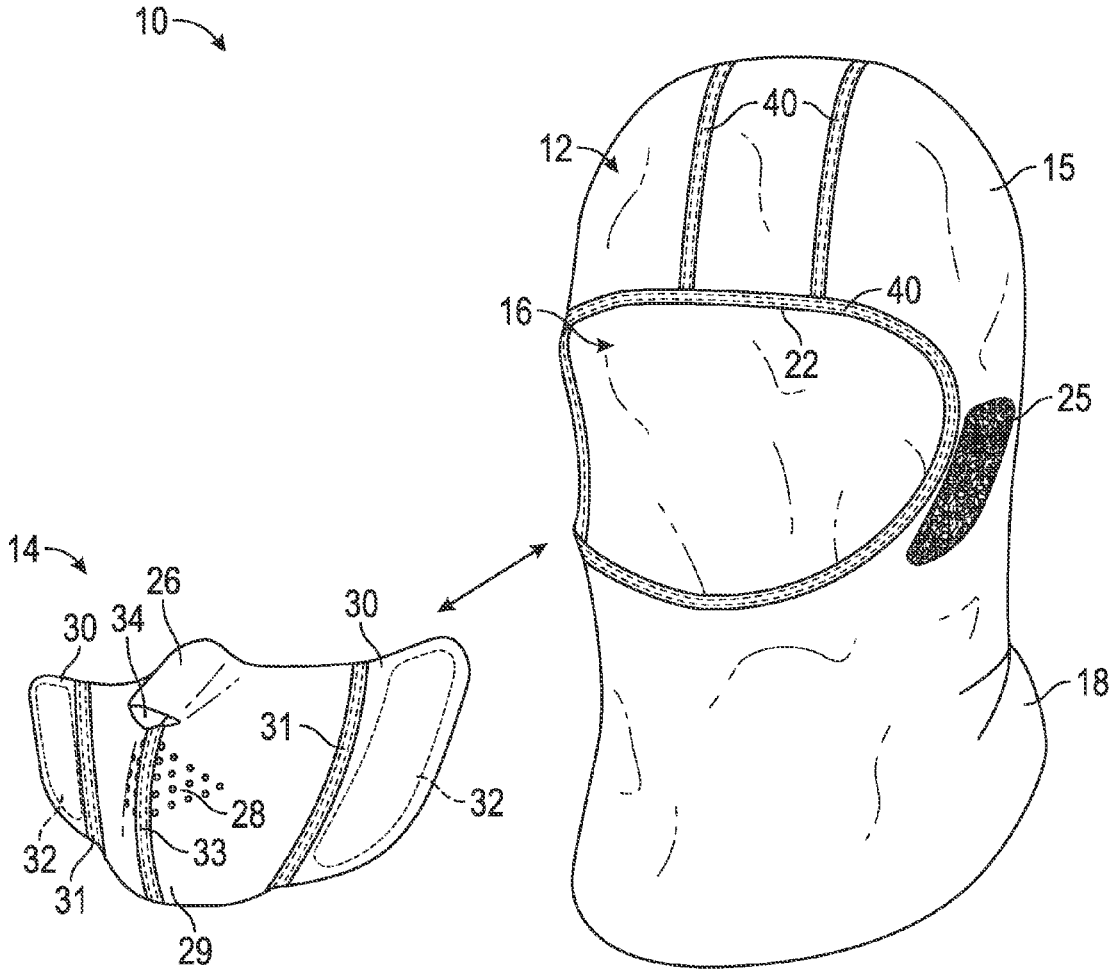
FIG. 1 is an exploded view of a first embodiment of a combined balaclava and face mask.
Figure 4:
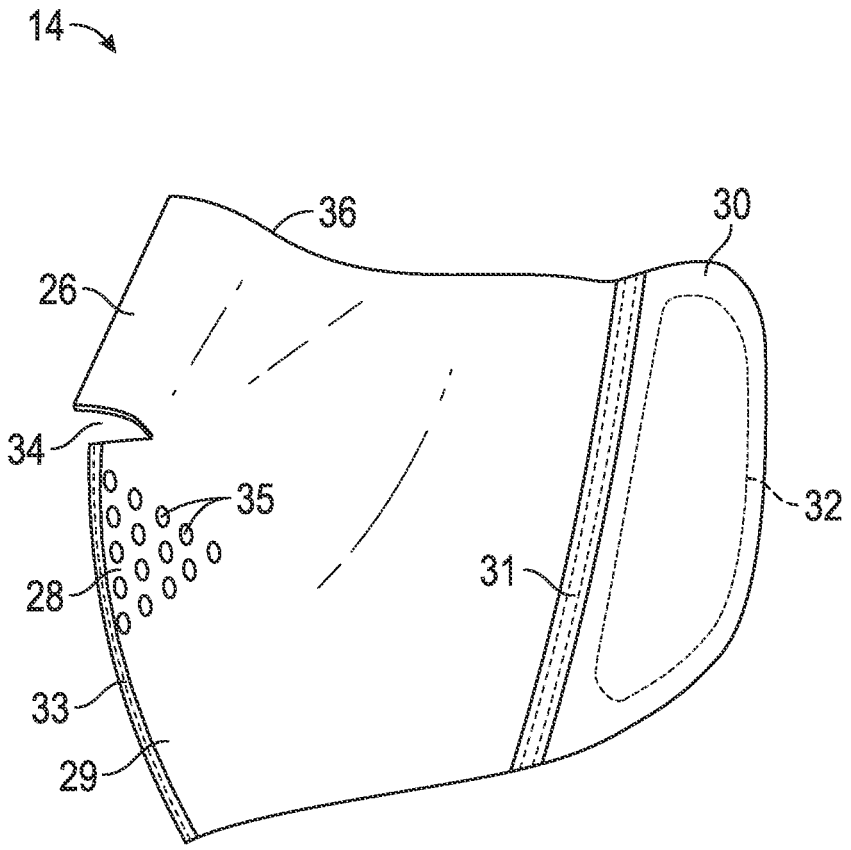
FIG. 4 is a side elevation view of the left side of the face mask of FIGS. 1 to 3.
Figure 5:
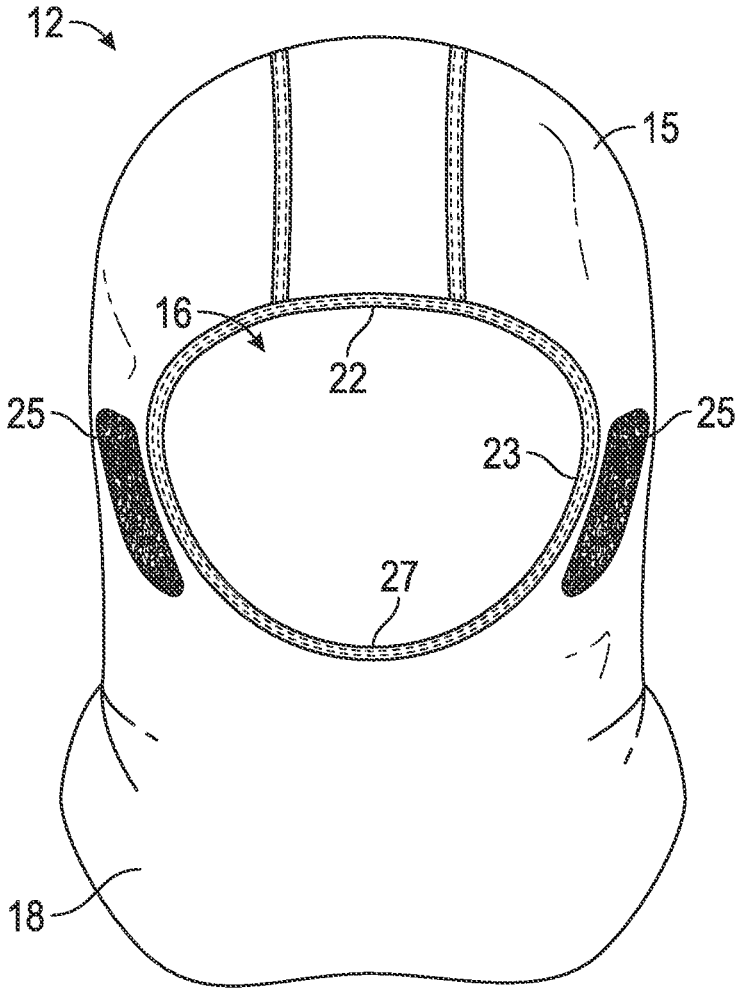
FIG. 5 is a front elevation view of the balaclava of FIG. 1 prior to attachment of a face mask.
Figure 6:
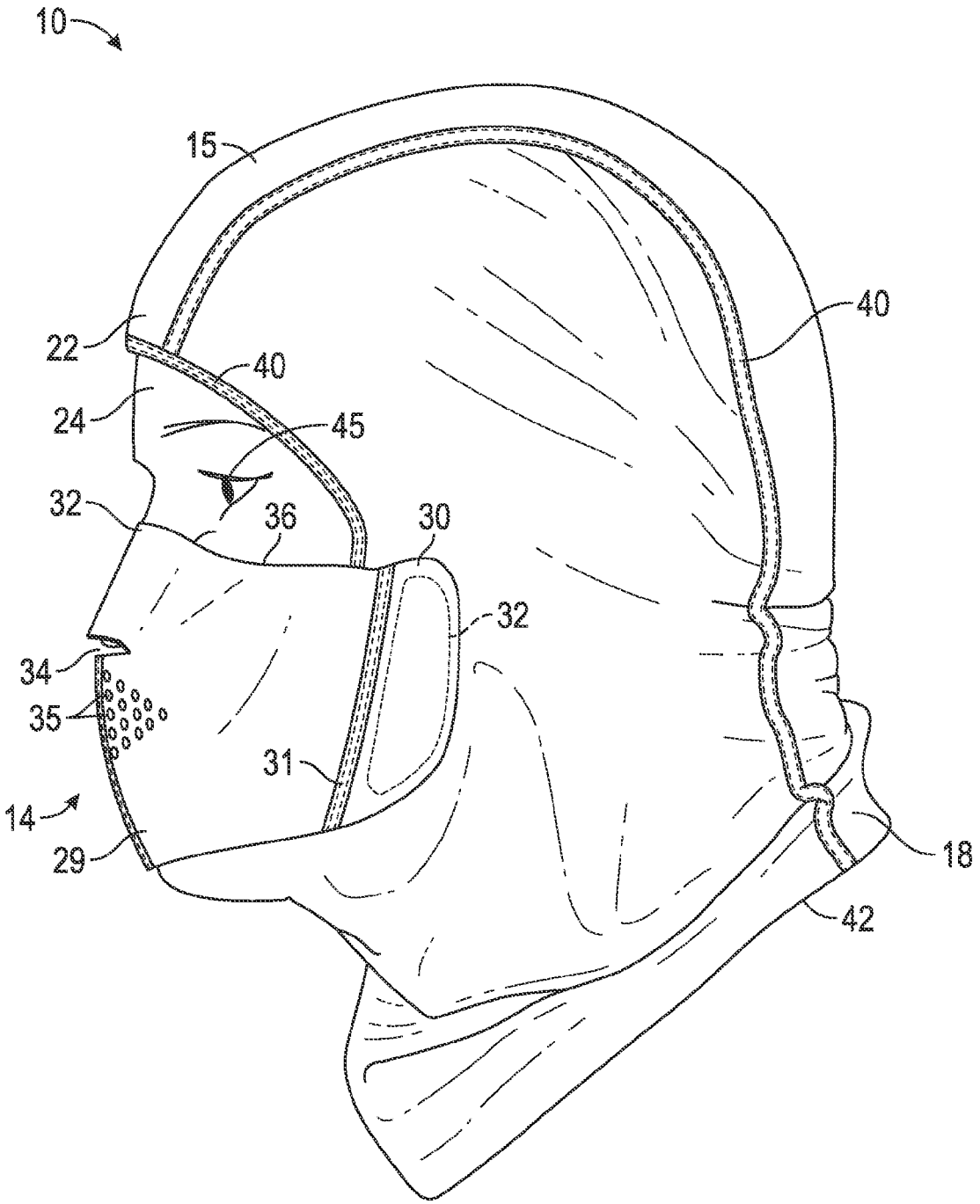
FIG. 6 is a side elevation view of the balaclava and face mask of FIGS. 1 to 5 worn by a user with the face mask attached.

FIGS. 1 to 6 illustrate a first embodiment of a combined balaclava and face mask device 10 comprising balaclava or head cover 12 of soft, flexible material and a face mask 14 of semi-soft, malleable material such as neoprene, nylon, cotton or other material. The mask material may be more insulating than the balaclava material or the same. FIG. 1 illustrates the balaclava 12 and face mask 14 separate from one another, while FIG. 6 illustrates the balaclava being worn by a user with the face mask 14 attached. The balaclava may be of suitably thin material designed to be worn as a liner for a helmet or other head protective device, or may be of insulating material for wearing alone. The balaclava head cover 12 is reversible which allows the wearer to have the seams of the balaclava facing inward or outward. Additionally the reversibility of the head cover 12 allows two design options one on the inside and one on the outside, depending on which side of the balaclava is facing to the outside.

Head cover or balaclava 12 has a head portion 15 which covers a wearer's head, a neck portion 18 extending downwardly from the head portion, and a face opening 16. Neck portion 18 is tubular and is designed to cover the entire circumference of the neck below the chin. The balaclava 12 is made of stretchable material which can be pulled over the users head. In some embodiments the neck portion 18 can extend below the neck and onto the chest to provide added warmth and protection. Neck portion 18 is formed integrally with the head portion at the rear of the balaclava. Face opening 16 has an upper front rim 22 which extends across the forehead, opposite side edges 23 extending down over opposite sides of a wearer's face 24, and a lower edge 27 extending across a lower part of the face when the balaclava is worn as in FIG. 6.

The head cover or balaclava 12 has some type of connector device which allows the removable face mask 14 to be releasably attached across the part of the face below the eyes 45, as seen in FIG. 6. The connector device may be one or more strips of hook-and-loop fastener material, as in the embodiments of FIGS. 1 to 10 (FIG. 1), a zipper (FIG. 12), snaps, buttons, hook and eye fasteners, or other types of connector device. In the embodiment of FIGS. 1 to 6, the connector device comprises a pair of fastener strips 25 of hook-and-loop fastener material, secured on opposite sides of the balaclava to extend adjacent opposite side edges 23 of the face opening, as seen in FIGS. 1 and 5. Fastener strips 25 are designed for releasable engagement with mating fastener strips 32 on the mask, as described in more detail below, with one pair of strips being of hook material and the other pair being of loop material. A snap, not shown, may also be located below the chin or in another location to allow the face mask 14 to be easily secured to the head cover 12 when it is not secured to the head covering by other means.

The drawings illustrate one embodiment of a soft material balaclava in which the face and neck portions are formed integrally, and seams 40 extend around face opening 16 and also extend from rim 22 at the front opening over the rear of the head portion and down to the lower rim 42 of the neck portion to secure opposite side portions of the device 12 to a central portion, as seen in FIGS. 1 and 6. However, the balaclava may be of different construction in alternative embodiments.

Figure 3:
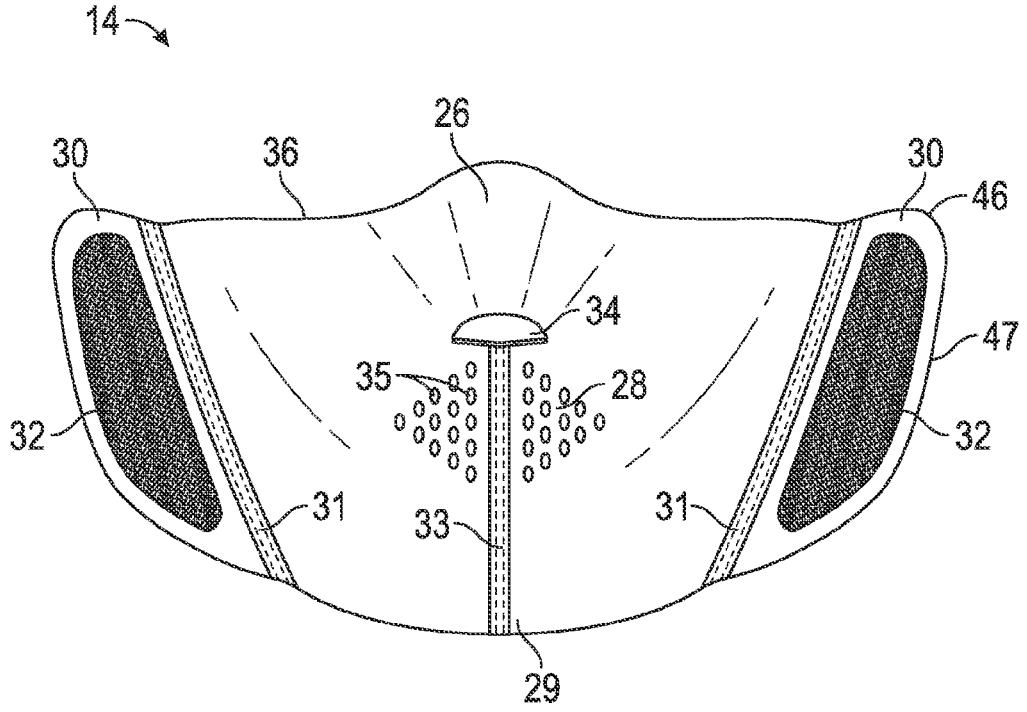
FIG. 3 is a rear elevation view of the face mask of FIGS. 1 and 2.

The face conforming mask 14 in one aspect is made of semi-soft malleable material such as neoprene which is preformed to match the general contours of a wearer's lower face below the eyes, with a protruding nose-receiving portion 26 and mouth portion 28, a lower portion 29 which curves rearward or inward to follow the curvature of a wearer's chin, and opposite left and right side portions or wings 30 which extend over opposite sides of a wearer's face when the mask is worn as in FIG. 6. In one embodiment, the left and right side portions are similar in shape to the wings of a stingray. In some embodiments the face mask 14 is made with dart notches located below the eyes on each side. The dart notches allow the mask to more securely form to the users face. Mask 14 has a periphery of shape and dimensions for fitting over a lower portion of opening 16 of the head cover 15 with the side portions 30 extending over fastener strips 25. Fastener strips 32 of hook-and-loop fastener material such as are sewn on the inner surface of each side portions 30 of mask 14 adjacent the side peripheral edge of the mask, as best illustrated in FIG. 3, for attachment to mating fastener strips 25 on opposite sides of the head cover 12. In one embodiment, fastener strips 25, 32 are of mating hook-and-loop type fastener material but in alternative embodiments the strips may be replaced by any suitable fasteners such as snap fasteners, buttons, hooks and eyes, zippers (FIG. 11-13) or the like.

Nose portion 26 of mask 14 is configured for engagement over the wearer's nose while allowing allow air to easily flow in and out of the nostrils. The nose portion 26 can have a pair of generally downwardly directed openings or apertures or a single aperture 34 designed for alignment with the wearer's nostrils when the portion 26 is engaged over a wearer's nose as in FIG. 6. In an alternate embodiment, the nose portion 26 may be formed of material which is permeable and easily allows the passage of air, but contains no holes. A plurality of small filter-like openings 35 are located across the mouth portion 28 so as to extend over the wearer's mouth when the mask is worn, to allow free talking and mouth breathing while restricting debris or insects from entering the wearer's mouth. In an alternate embodiment the mouth portion 28 can contain a mesh filter.

Figure 2:
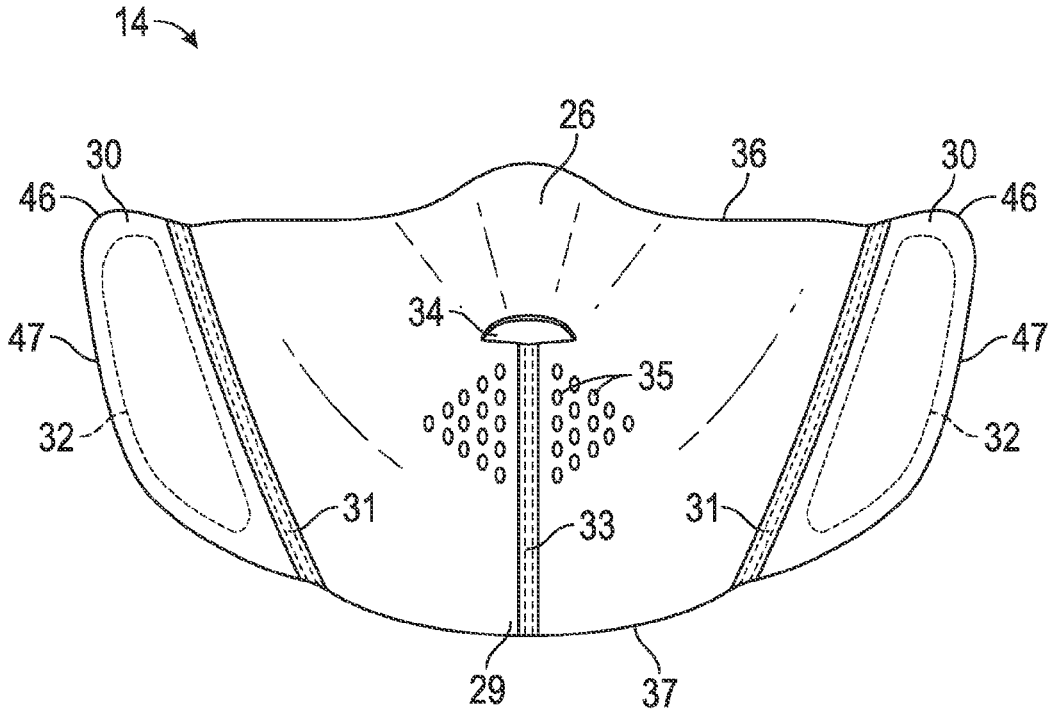
FIG. 2 is a front elevation view of the face mask of FIG. 1.

As best illustrated in FIGS. 2 to 4, a respective seam or line of stitching 31 is sewn in each side portion 30 of the mask to extend in an arc or rounded path from the upper edge or rim 36 to the lower edge or rim 37 of the mask, just inside the respective strip 32 of hook or loop fastener material. These seams form hinge regions which allow the mask to form better to the face of the wearer. A third seam 33 is sewn from the lower edge of nose opening 34 to the lower edge of the mask, also allowing the mask to curve or flex inward more easily around opposite sides of the mouth and chin.

A central portion of face mask 14 including the nose portion, mouth portion and chin portion covers the portion of face opening 16 below the wearer's eyes when the balaclava and mask are worn together as in FIG. 6, while outer ends of the side portions 30 extend over corresponding left and right sides of the balaclava. The upper edge or rim 36 has a central convex portion forming the upper edge of nose portion 26, and concave arcuate portions extending outward from opposite sides of the central convex portion to rounded outer tips 46 of the side or wing shaped portions of the mask. Opposite side edges 47 of the mask are inclined or rounded inwardly from respective tips 46 to the lower edge 37 of the mask. The lower edge 37 is of convex curvature to substantially follow the curvature of a wearer's chin. The left and right fastener strips 32 are sewn to outer portions of the left and right wings of the mask adjacent side edges 47 and taper inward at a similar taper angle and the mating left and right fastener strips 25 on the balaclava are inclined at a similar angle, as seen in FIGS. 1, 5 and 6.

As noted above, mask 14 is made of a suitable semi-soft formable or malleable material such as neoprene or neoprene with outer fabric layers, and may be shaped or molded to follow the general contours of a human face below the eyes by sewing or forming and heating. In one embodiment, the material along with the contours on the inner face are designed so that the material is slightly stretched when attached to the balaclava and tends to hug the user's face when worn as in FIG. 6.

In order to attach the mask 14 in face opening 16 of the head cover or balaclava 12, the user simply engages or presses the respective fastener strips 32 of the mask against the mating fastener strips 25 on opposite sides of the face opening. This may be done before donning the balaclava, or after donning the balaclava without the face mask. This arrangement allows the balaclava or head cover to be selectively worn without the mask, for example when the balaclava is primarily needed for warmth only, or with the mask as in FIG. 6 to protect the face in inclement conditions or while the wearer is outdoors in bad weather conditions or engaged in various activities such as outdoor sports and activities, motorcycle riding, mountain bike riding, skiing, other extreme sports, and the like. When the mask is attached in the face opening as in FIG. 6, it covers the lower part of the face below the eyes down to the chin, providing a shield to the nose and mouth while allowing the wearer to breathe through the nostril aperture or apertures 34 in nose portion and also through openings 35 in mouth portion 28. If the user decides that further filtration is needed, a finer filter mask may be engaged inside the mask 14 between the mask 14 and the user's face. The balaclava and mask may be worn together with ski goggles, motor cycle goggles, or other eye protective wear as needed, so that the entire head, neck and face are covered.

As illustrated in FIG. 6, when a user or wearer is wearing the balaclava 12 with the mask 14 attached over the lower part of face opening 16, upper rim 36 of the mask extends over the bridge of the wearer's nose and under the eyes 45 between opposite sides of the wearer's face, and the mask substantially covers the lower part of the face (apart from the nostril and filter openings). This has the advantage of both insulating and protecting the covered face region, while providing openings over the nostrils and mouth to allow breathing. If desired, the wearer can quickly and easily remove the mask to expose the lower face while still wearing the balaclava for warmth, and can also easily re-attach the mask when needed. In some embodiments, the user can also attach the mask when otherwise removed to an optional fastener or enclosure located on the head cover 15 so that it is not lost or misplaced when it is not being worn.

Figure 7:
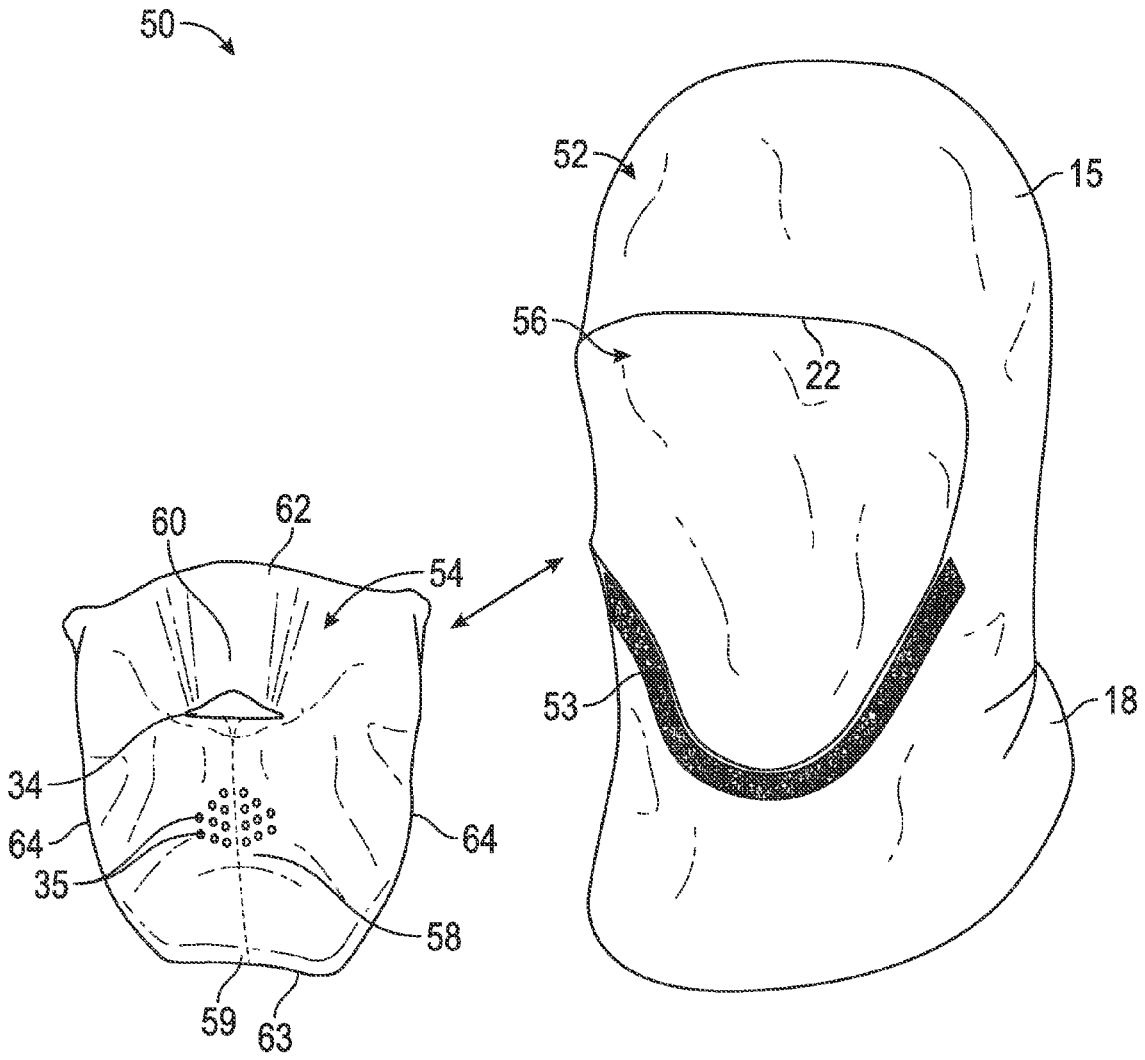
FIG. 7 is an exploded view of a second embodiment of a combined balaclava and face mask.
Figure 8:
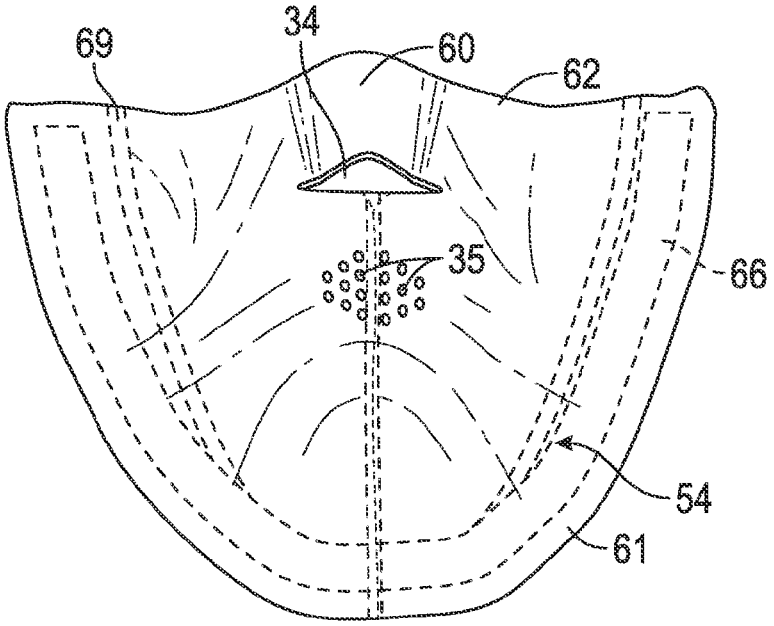
FIG. 8 is a front elevation view of the face mask of FIG. 7.
Figure 9:
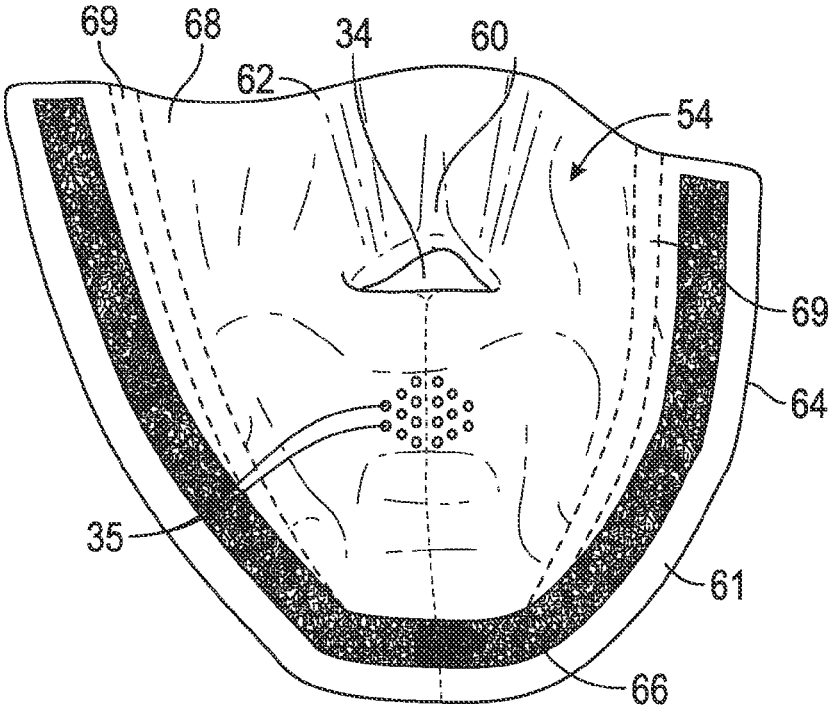
FIG. 9 is a rear elevation view of the face mask of FIGS. 7 and 8.
Figure 10:
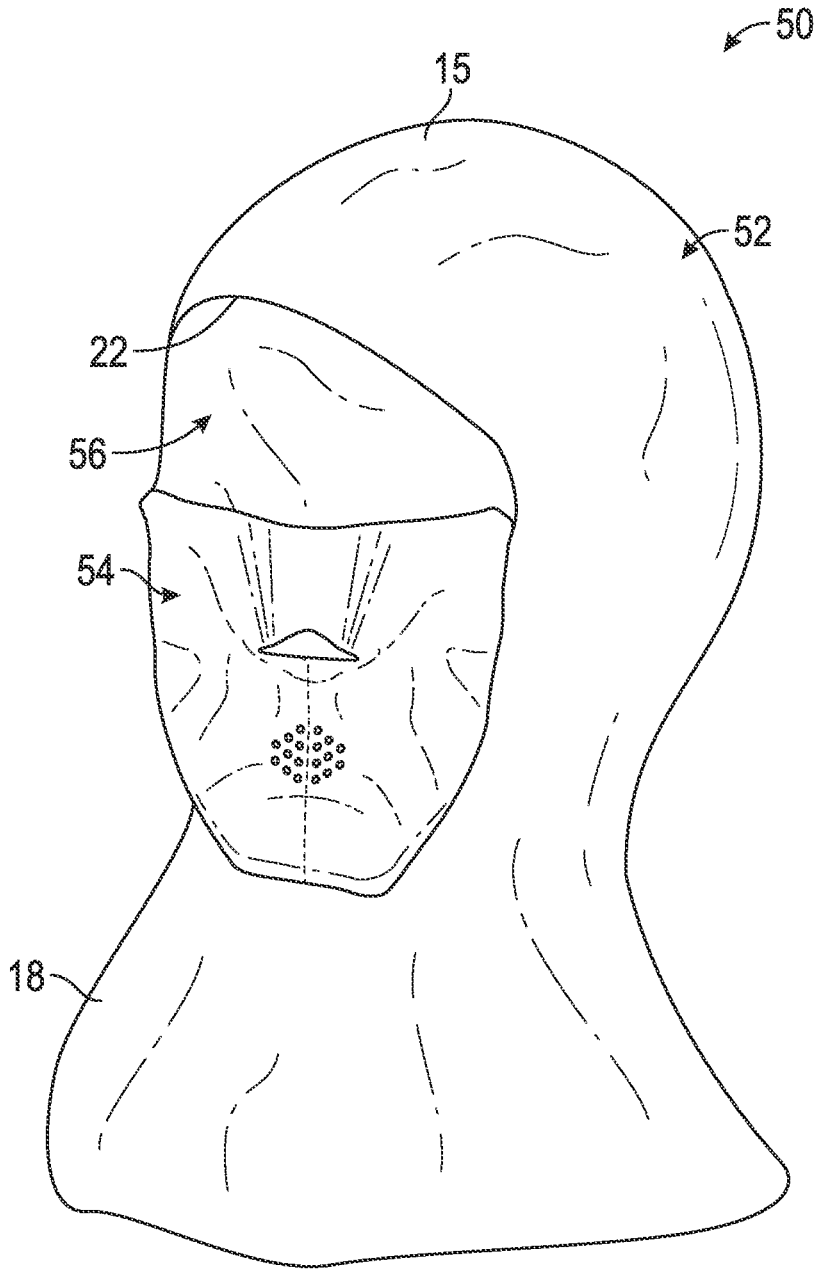
FIG. 10 is a perspective view of the balaclava of FIG. 7 with the face mask of FIGS. 7 to 9 attached.

FIGS. 7 to 10 illustrate a second embodiment of a combined balaclava and face mask device 50 comprising balaclava or head cover 52 of soft, flexible material and a face mask 54 of semi-soft, malleable material such as neoprene, nylon, cotton or other material. The mask material may be more insulating than the balaclava material or the same. FIG. 7 illustrates the balaclava and mask separately, while FIG. 10 illustrates the balaclava with the face mask 54 attached. As in the first embodiment, the balaclava may be of suitably thin material designed to be worn as a liner for a helmet or other head protective device, or may be of insulating material for wearing alone. Apart from a larger face opening 56 and the different arrangement of fastener device or devices 53 for attachment of the mask 54, the balaclava may be identical to balaclava 12 of the first embodiment, and like reference numbers are used for like parts as appropriate. In one embodiment the head cover 52 can include a fastener device on the back of the neck portion to connect a scarf which can be made of cotton, bamboo, fiber or other material.

Head cover or balaclava 52 has a head portion 15 which covers a wearer's head, a neck portion 18 extending downwardly from the head portion, and face opening 56. Neck portion 18 is tubular and is designed to cover the entire circumference of the neck below the chin. The balaclava or head cover 52 is made of stretchable material which can be pulled over the user's head.

Figure 12:
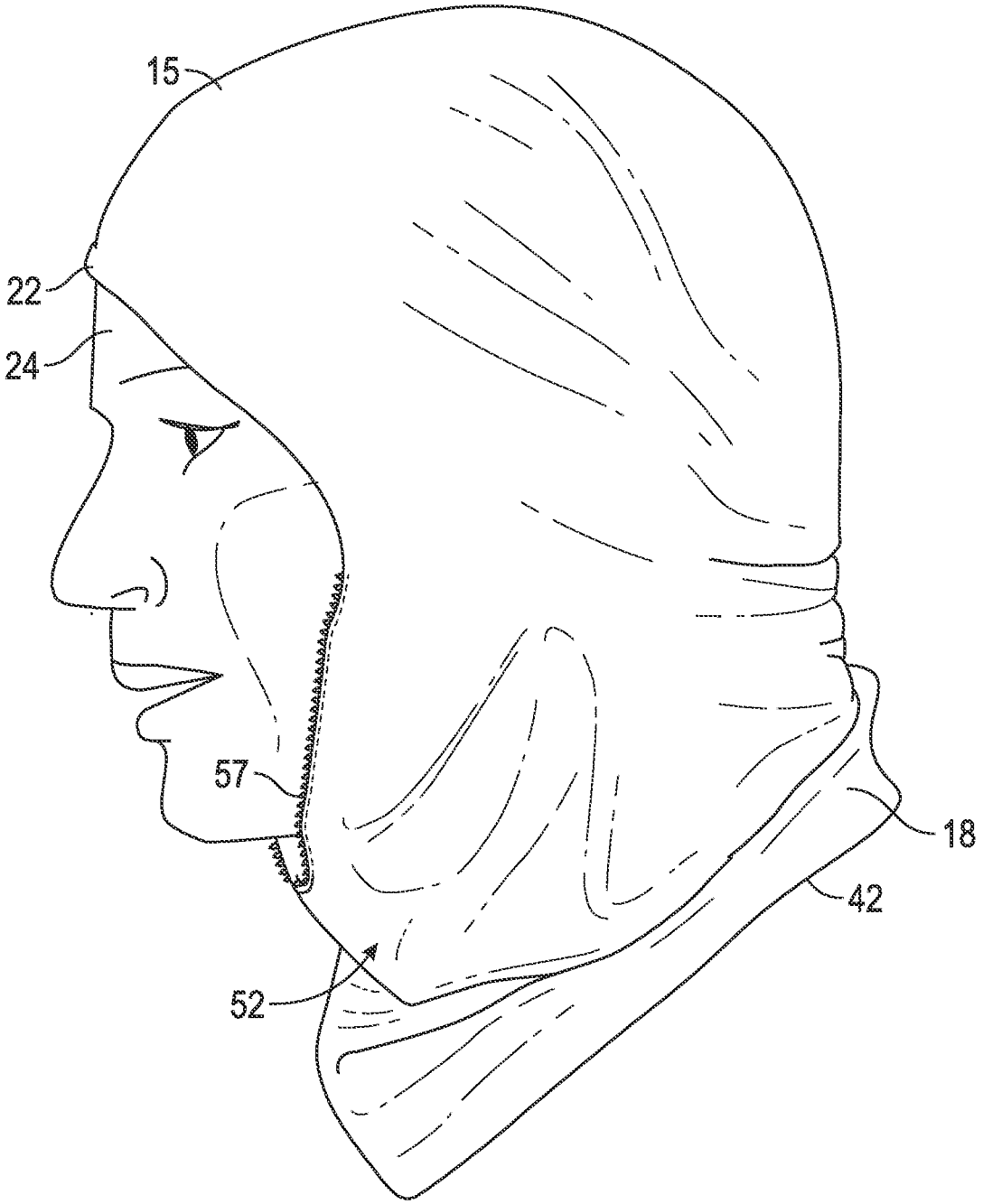
FIG. 12 is a side elevation view of a balaclava similar to the balaclava of FIG. 7 but with a zipper fastener, worn by a user without the removable face mask.

The lower outside edge of the head cover 52 has some type of connector device 53 adjacent the lower or side edges of the face opening 56 which allows the removable face mask 54 to be attached. The connector device can be one or more strips of hook-and-loop fastener material. In one embodiment, the connector devices are made of multiple pieces such as multiple strips of hook or loop fastener material to allow for enhanced fit about the wearer's face. A continuous strip or other fastener device may be used when the removable face mask requires a more secure connection, for example during more extreme activities. FIG. 12 illustrates an alternative embodiment where the fastener strip 56 is replaced by one half of a zipper fastener 57. Other types of connector device may be used, such as snaps, buttons, hook and eye fasteners, or the like. Connector devices may be secured to the outer or inner surface of the neck portion of the head cover adjacent the lower rim of face opening 56.

As in the first embodiment, the face conforming mask 54 of this embodiment is made of semi-soft malleable material such as neoprene which is preformed to match the general contours of a wearer's lower face below the eyes, as in the previous embodiment. However, the shape of the mask is different since it has a more extended lower portion 59 which extends farther under the chin area and substantially matches the shape of the lower part of the face opening in balaclava 52. As in the previous embodiment, mask 54 has a protruding nose-receiving portion 60 and mouth portion 58. Lower portion 59 curves rearward or inward to follow the curvature of a wearer's chin. In some embodiments the face mask 54 is made with dart notches located below the eyes on each side, to allow the mask to form more securely to the wearer's face. Mask 54 has a periphery of shape and dimensions for fitting over a lower portion of opening 56 of the head cover 52. The periphery has an upper rim 62 designed to extend across the opening, a lower edge 63 and side peripheral edges 64 extending up to upper rim 62 to form a generally U-shaped periphery with lower edge 63, as seen in FIGS. 8 and 9.

Nose portion 60 of mask 54 is configured to allow air to easily flow out of the nostrils and has one or a pair of generally downwardly directed openings or apertures 34 as in the previous embodiment designed for alignment with the wearer's nostrils when the portion 60 is engaged over a wearer's nose. As in the first embodiment, a plurality of small filter-like openings 35 are located across the mouth portion 58 so as to extend over the wearer's mouth when the mask is worn, to allow free talking and mouth breathing while restricting debris or insects from entering the wearer's mouth.

Figure 11:
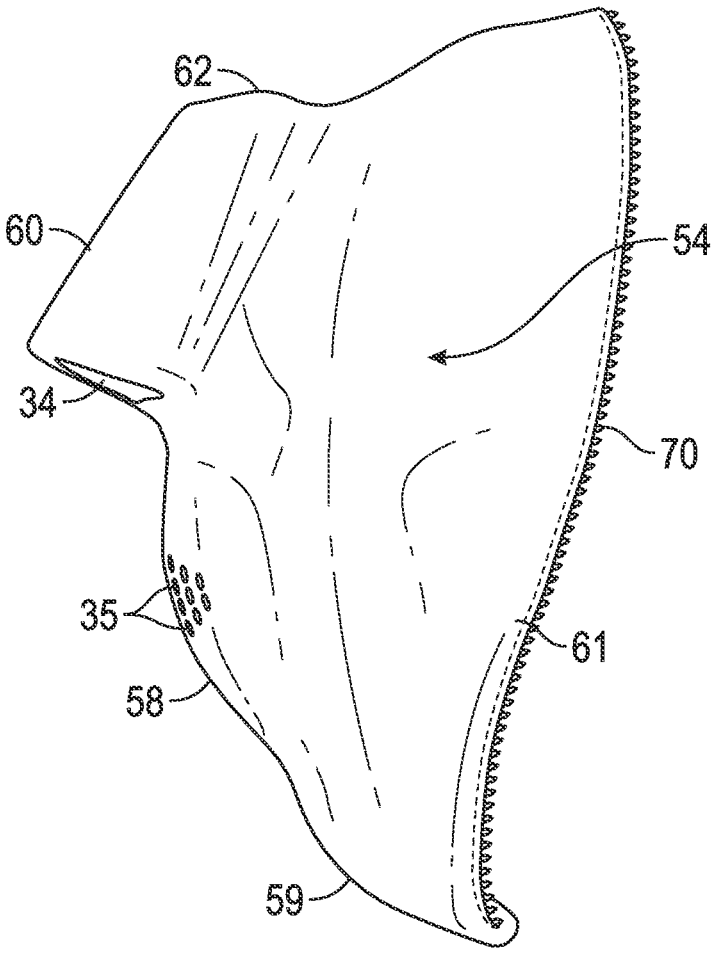
FIG. 11 is a side elevation view of the left side of a modified face mask similar to the face mask of FIGS. 7 to 10, but with an alternative zipper fastener mechanism in place of the hook-and-loop fastener strip or strips.
Figure 13:
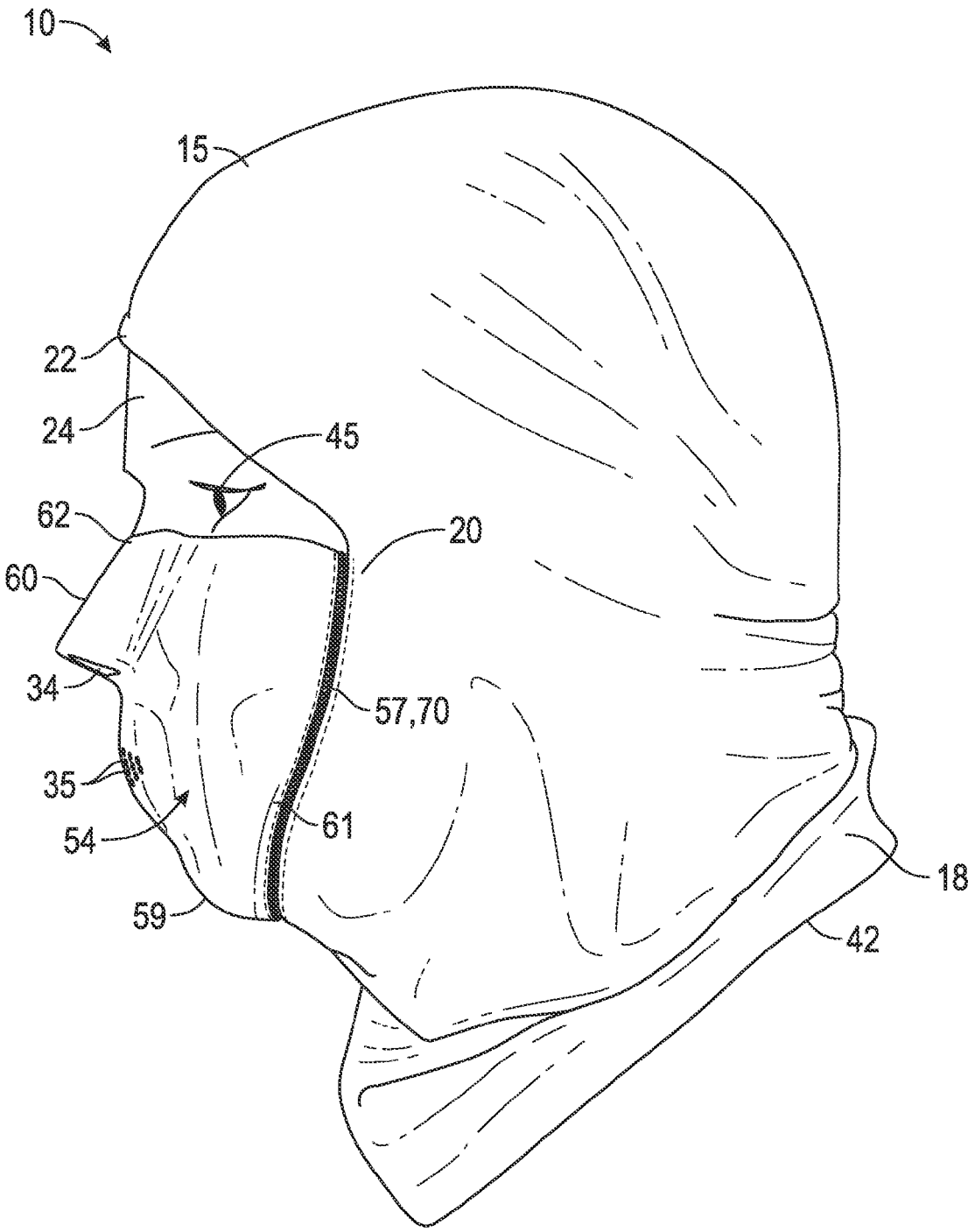
FIG. 13 is a side elevation view of the balaclava as worn in FIG. 12 with the face mask of FIG. 11 attached over the lower portion of the wearer's face.

As illustrated in FIG. 3, one or more fastener strips 66 of hook-and-loop fastener material are located on the inner face 68 of the mask extending around a peripheral edge portion 61 spaced inward from the generally U-shaped lower and side peripheral edges 63, 64 of the mask. One fastener strip or two or more spaced fastener strips may be spaced around peripheral edge portion 61, for example strips spaced at equal intervals apart and located along opposite side edges of the inner surface of the mask. In one embodiment, the fastener strip or strips are of hook-and-loop type fastener material, but in alternative embodiments the fastener strip or strips may be replaced by any suitable fasteners such as snap fasteners, buttons, hooks and eyes, zippers (see FIGS. 11 to 13) or the like. In the alternative of FIGS. 11 to 13, mask 54 is identical to the mask of FIGS. 7 to 10 except that fastener strip or strips 66 on the inner face of the mask are replaced by zipper half 70 extending along the rim of the mask. Zipper half 70 is releasably mateable with matching zipper half 57 on the corresponding part of the face opening 56 of balaclava 52, as seen in FIG. 13.

As noted above, mask 54 is made of a suitable semi-soft formable or malleable material such as neoprene alone or neoprene with outer fabric layers, and may be shaped or molded to follow the general contours of a human face below the eyes by sewing or forming and heating. In one embodiment, the material along with the contours on the inner face are designed so that the material is slightly stretched when attached to the balaclava and tends to hug the user's face when worn as in FIG. 10. In one embodiment, mask 54 also has rows of stitching or side seams 69 sewn on opposite sides of the mask inside the fastener strip or strips 66 and each extending from the upper edge 62 and extending in a generally inward, arcuate path towards the lower edge 66, as illustrated in FIGS. 8 and 9. As noted above in connection with side seams 31 of mask 14, the seams 69 allow the mask to flex more easily and form better to opposite sides of the wearer's face.

In order to attach the mask 54 in face opening 56 of the head cover or balaclava 52, the user simply engages or presses the respective fastener strips 66 of the mask against the mating fastener strips 53 in the face opening, as in FIG. 10, or zips the mask 54 onto the head cover 52 via zip halves 57 and 70, as seen in FIGS. 11 to 13. This may be done before donning the balaclava, or after donning the balaclava without the face mask as in FIG. 12. This arrangement allows the balaclava or head cover to be selectively worn without the mask as in FIG. 12, for example when the balaclava is primarily needed for warmth only, or with the mask as in FIG. 7 or 13 to protect the face in inclement conditions or while the wearer is outdoors in bad weather conditions or engaged in various activities such as outdoor sports and activities, motorcycle riding, mountain bike riding, skiing, other extreme sports, and the like. When the mask is attached in the face opening as in FIG. 7 or 13, it covers the lower part of the face below the eyes down to the chin, providing a shield to the nose and mouth while allowing the wearer to breathe through the nostril apertures 34 in nose portion and also through openings 35 in mouth portion 58. If the user decides that further filtration is needed, a finer filter mask may be engaged inside the mask 54 between the mask 54 and the user's face. As in the previous embodiment, the balaclava and mask may be worn together with ski goggles, motor cycle goggles, or other eye protective wear as needed, so that the entire head, neck and face are covered.

The above figures may depict exemplary configurations for the invention, to aid in understanding the features and functionality that can be included in the invention. The invention is not restricted to the illustrated architectures or configurations, but can be implemented using a variety of alternative architectures and configurations. Additionally, although the invention is described above in terms of various exemplary embodiments and implementations, it should be understood that the various features and functionality described in one or more of the individual embodiments with which they are described, but instead can be applied, alone or in some combination, to one or more of the other embodiments of the invention, whether or not such embodiments are described and whether or not such features are presented as being a part of a described embodiment. Thus the breadth and scope of the present invention, especially in any following claims, should not be limited by any of the above-described exemplary embodiments.

The terms and expressions employed herein have been used as terms of description and not of limitation, and there is no intention in the use of such terms and expressions of excluding any equivalent of the invention shown or portion thereof, but it is recognized that various modifications are possible within the scope of the invention claimed. Accordingly, the present invention should be construed to embrace all modifications, alternatives, and variations apparent to those skilled in the art that fall within the spirit and broad scope of the claims.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein are representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

I claim:

1. A head cover and face mask device, comprising:

a balaclava of soft, flexible material having a head portion configured for covering a wearer's head and a generally tubular neck portion integral with the head portion and extending downwards from the head portion and configured for covering at least part of the wearer's neck, the balaclava having a front face opening configured for alignment with a wearer's face when the balaclava is worn;

the face opening having a periphery having an upper rim configured for positioning over an upper region of a wearer's face above the wearer's eyes, opposite left and right side rims configured for positioning on opposite sides of a wearer's face, and a lower rim configured for positioning below at least part of a wearer's chin region, the neck portion having a front region extending downwardly from the lower rim of the face opening;

a face mask of semi-soft malleable material different from the balaclava material, the face mask being releasably attachable over the lower rim and part of the side rims of the face opening of the balaclava and having a lower portion extending over part of the front region of the neck portion of the balaclava, the face mask being configured to be positioned below the wearer's eyes and being adapted to conform substantially to contours of a wearer's face below the eyes when the balaclava is worn with the face mask attached;

the face mask having an outer surface, an inner surface, a peripheral rim, a nose portion shaped to conform with a wearer's nose and a mouth portion shaped to engage over a wearer's mouth when the mask is worn;

the nose portion having at least one opening positioned for alignment with the wearer's nostrils and the mouth region having a plurality of spaced filter openings with no outer cover member extending in front of the opening or filter openings;

one or more first fastener devices on the inner or outer surface of the face mask; and one or more second fastener devices on the balaclava configured and positioned for releasable mateable engagement with the one or more fastener devices on the face mask.

2. The device of claim 1, wherein the one or more first and second fastener devices are selected from the group consisting of mating hook-and-loop fastener material, zippers, snaps, hook and eye fasteners, and buttons.

3. The device of claim 2, wherein the one or more first fastener devices comprise one or more first strips of hook-and-loop fastener material and the one or more second fastener devices comprise one or more second strips of hook-and-loop fastener material releasably attachable to the one or more first strips.

4. The device of claim 3, wherein the one or more first strips comprise a pair of first strips and the one or more second strips comprise a pair of second strips of substantially matching shape and size to the respective first strips.

5. The device of claim 4, wherein one of the second strips comprises a left second strip located on a portion of the balaclava spaced from the left side rim of the face opening and the other of the second strips comprises a right second strip located on a portion of the balaclava spaced from the right side rim of the face opening, and the face mask has opposite left and right side portions, the pair of first strips comprising left and right first strips located on the inner surface of the face mask in the left and right side portions of the face mask, respectively.

6. The device of claim 3, wherein the one or more second strips comprise at least two second strips arranged adjacent at least part of the left and right side rims of the face opening of the balaclava, and the one or more first strips are positioned on the inner surface of the face mask for mating engagement with the second strips when the face mask is releasably attached to the balaclava.

7. The device of claim 6, wherein the one or more second strips further comprise at least one second strip extending adjacent the lower rim of the face opening.

8. The device of claim 1, wherein the first and second fastener devices comprise a first zipper portion on lower rim and opposite side rims of the mask and a second zipper portion located around opposing portions of the peripheral rim of the face opening of the balaclava and configured to be releasably zipped to the first zipper portion.

9. The device of claim 1, wherein the face mask is made of neoprene.

10. The device of claim 1, wherein the face mask is configured to extend below a wearer's chin.

11. The device of claim 1, wherein the face mask has a central portion configured to extend over a predetermined portion of the face opening and opposite left and right side portions configured to extend over corresponding left and right portions of the balaclava on opposite sides of the face opening when the face mask is releasably attached to the balaclava.

12. The device of claim 11, wherein the first and second fastener devices comprise first and second left mateable fastener devices on the inner surface of the left side portion of the face mask and on the left portion of the balaclava, respectively, and first and second right mateable fastener devices on the inner surface of the right side portion of the face mask and on the right portion of the balaclava, respectively.

13. The device of claim 12, wherein the face mask has an upper edge, a lower edge, and opposite left and right side edges, the first left fastener device is located adjacent the left side edge and the first right fastener device is located adjacent the right side edge.

14. The device of claim 13, wherein the first left fastener device comprises at least one strip of hook-and-loop fastener material adjacent the left side edge, and the first right fastener device comprises at least one strip of hook-and-loop fastener material adjacent the right side edge.

15. A head cover and face mask device, comprising:

a balaclava of soft, flexible material having a head portion configured for covering a wearer's head and a generally tubular neck portion integral with the head portion and extending downwards from the head portion and configured for covering at least part of the wearer's neck, the balaclava having a front face opening configured for alignment with a wearer's face when the balaclava is worn;

the face opening having a periphery having an upper rim configured for positioning over an upper region of a wearer's face above the wearer's eyes, opposite left and right side rims configured for positioning on opposite sides of a wearer's face, and a lower rim configured for positioning below at least part of a wearer's chin region, the neck portion having a front region extending downwardly from the lower rim of the face opening;

a face mask of semi-soft malleable material different from the balaclava material, the face mask being releasably attachable over the lower rim and part of the side rims of the face opening of the balaclava and having a lower portion extending over part of the front region of the neck portion of the balaclava, the face mask being configured to be positioned below the wearer's eyes and being adapted to conform substantially to contours of a wearer's face below the eyes when the balaclava is worn with the face mask attached;

the face mask having an outer surface, an inner surface, a peripheral rim, a nose portion configured for engagement with a wearer's nose and a mouth portion shaped to engage over a wearer's mouth when the mask is worn;

one or more first fastener devices on the inner or outer surface of the face mask;

one or more second fastener devices on the balaclava configured and positioned for releasable mateable engagement with the one or more fastener devices on the face mask; and the face mask having an upper edge, a lower edge, and opposite left and right side edges, a left stitched seam line extending in a generally arcuate inward path from the upper edge to the lower edge of the face mask at a location spaced inward from the left side edge and a right stitched seam line extending in a generally arcuate inward path from the upper edge to the lower edge of the face mask at a location spaced inward from the right side edge, the left and right stitched seam lines being located on opposite sides of a wearer's face at locations which are closer to the respective left and right side rims of the face opening than to the mouth portion of the face mask, whereby the left and right stitched seam lines form hinge regions configured to allow adjacent regions of the mask to conform more closely to the face of a wearer; the nose portion having at least one opening positioned for alignment with the wearer's nostrils and the mouth region having a plurality of spaced filter openings with no outer cover member extending in front of the opening or filter openings.

16. A head cover and face mask device, comprising:

a balaclava of soft, flexible material having a head portion configured for covering a wearer's head and a generally tubular neck portion integral with the head portion and extending downwards from the head portion and configured for covering at least part of the wearer's neck, the balaclava having a front face opening configured for alignment with a wearer's face when the balaclava is worn;

the face opening having a periphery having an upper rim configured for positioning over an upper region of a wearer's face above the wearer's eyes, opposite left and right side rims configured for positioning on opposite sides of a wearer's face, and a lower rim configured for positioning below at least part of a wearer's chin region, the neck portion having a front region extending downwardly from the lower rim of the face opening;

a face mask of semi-soft malleable material different from the balaclava material, the face mask being releasably attachable to the lower rim and part of the side rims of the face opening of the balaclava, the face mask being configured to be positioned below the wearer's eyes and to conform substantially to contours of a wearer's face below the eyes when the balaclava is worn with the face mask attached;

the face mask having an outer surface, an inner surface, a peripheral rim having an upper rim, opposite side rims, and a lower rim, a nose portion shaped to conform to a wearer's nose and a mouth portion shaped to engage over a wearer's mouth;

the nose portion having at least one opening positioned for alignment with the wearer's nostrils and the mouth region having a plurality of spaced filter openings; with no outer cover member extending in front of the opening or filter opening;

a plurality of first fastener devices on the inner surface of the face mask, at least one first fastener device located adjacent each of the lower rim and respective opposite side rims of the face mask; and a plurality of second fastener devices on the balaclava, at least one second fastener device located adjacent the lower rim of the face opening and additional second fastener devices located on respective side portions of the balaclava spaced outward from respective opposite left and right side rims of the balaclava, the second fastener devices being configured and positioned for releasable mateable engagement with the respective opposing first fastener devices on the face mask.

* * * * *